US005797447A

United States Patent [19]

Nir

[11] Patent Number: 5,797,447

[45] Date of Patent: Aug. 25, 1998

[54] HEAT RECOVERY SYSTEM

[76] Inventor: Ari Nir, 2600 Netherlands Ave., Bronx, N.Y. 10463

[21] Appl. No.: 780,365

[22] Filed: Jan. 9, 1997

Related U.S. Application Data

[63] Continuation-in-part of Ser. No. 615,809, Mar. 14, 1996, Pat. No. 5,626,102.

[51] Int. Cl.[6] ..... F28D 7/10

[52] U.S. Cl. ..... 165/140

[58] Field of Search ..... 165/140

[56] References Cited

U.S. PATENT DOCUMENTS 573,111 12/1896 Shepard ..... 165/140

*Primary Examiner*—Noah P. Kamen

*Attorney, Agent, or Firm*—Ilya Zborovsky

[57] ABSTRACT

A heat recovery system has a heat exchanger provided with a first tube bundle for circulating a first fluid which does not change its phase state and a second tube bundle for circulating a second fluid which changes its phase state, the heat exchanger being also provided with a shell which accommodates the tube bundles arranged in series in the shell, so that when a third fluid is circulated through the shell it successively contacts the tube bundles for a heat transfer between the third fluid and a respective one of the two first-mentioned fluids.

6 Claims, 6 Drawing Sheets

HEAT RECOVERY SYSTEM

CROSS-REFERENCE TO A RELATED APPLICATION

This application is a continuation-in-part of the U.S. patent application Ser. No. 08/615,809 filed on Mar. 14, 1996, now U.S. Pat. No. 5,626,102.

BACKGROUND OF THE INVENTION

The present invention relates to a heat recovery system.

More particularly, it relates to a heat recovery system which has a heat exchanger for a heat transfer between fluids.

Heat recovery systems of the above mentioned general type are known in the art. In known heat recovery systems one fluid is supplied through a tube bundle arranged in a shell of a heat recovery system, while the other fluid is supplied into the shell of the heat recovery system so that a heat transfer is performed between the two fluids. It is important to increase intensification of the heat transfer between the fluids.

SUMMARY OF THE INVENTION

Accordingly, it is an object of the present invention to provide a heat recovery system which has an improved intensification of a heat transfer between the fluids.

In keeping with these objects and with others which will become apparent hereinafter, one feature of the present invention of the resides, briefly stated, in a heat recovery system which includes a heat exchanger provided with two tube bundles for circulation of a first fluid which does not not change its phase state and a second fluid which does change state, and a shell which accommodates the tube bundles in series with one another and through which a third fluid is circulated to successively be brought into a heat transfer with the first mentioned two fluids.

When the heat recovery system is designed in accordance with the present invention, it provides for a substantially intensified heat transfer between the fluids.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
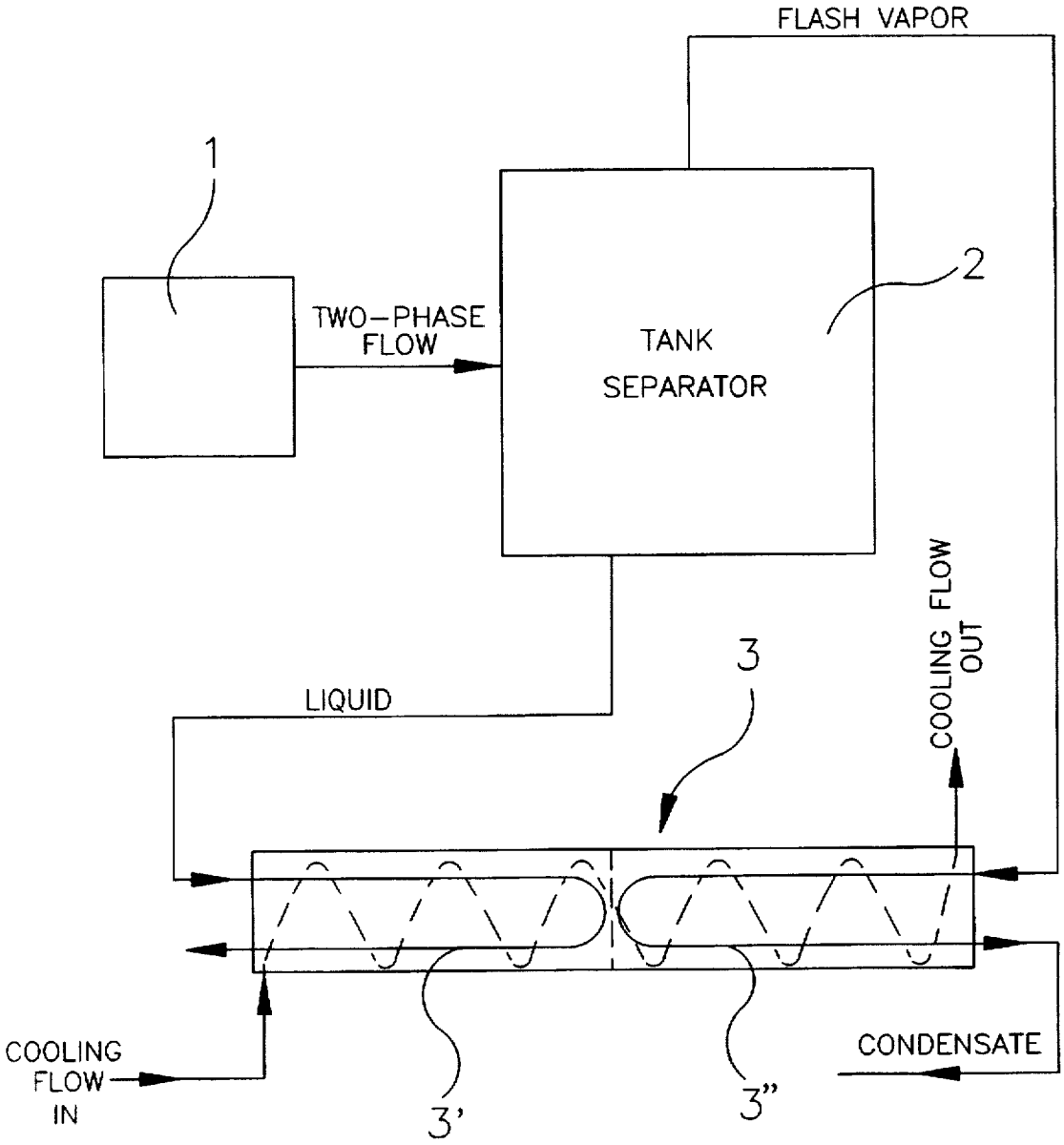
FIG. 1 of the drawings is a view schematically showing a heat recovery system in accordance with the present invention.

A heat recovery system in accordance with the present invention is shown in general in FIG. 1. The system includes a source of a two-phase flow which can be for example a boiler. A tank separator 2 is connected to the source of the two-phase flow, in which the flow is subdivided into two fluids having different phase states, in particular into liquid and vapor. If the source 1 is a boiler, the tank separator 2 subdivides the liquid supplied from the boiler into a blow down water and a flush steam. The system is provided with a heat exchanger which is identified as a whole with reference numeral 3. The liquid (the blow down water) is supplied from the tank separator into a left part 3' of the heat exchanger which is provided with a first tube bundle, and flows through the tube bundle so as to be discharged at the end, for example into a sewage. The fluid supplied in the left tube bundle can be a fluid which does not change its phase state, and in particular is liquid. The vapor (flush steam) is supplied to a right portion 3" of the heat recovery system provided with a second tube bundle and flows through the second tube bundle in which it condenses. The fluid in the tube bundle in the right portion 3" of the heat exchanger 3 is a fluid which changes its phase state. A third fluid which is a heated flow and in this case can be a make up water, is supplied into a shell which surrounds both tube portions located in series with one another, so that the heated flow first flows around the left tube bundle located in the left part 3' of the heat recovery system, then flows around the right tube bundle located in the right part 3" of the heat recovery system, and then is withdrawn from the shell. In the example with the heat recovery system from the boiler, the cold flow or the make up water supplied for example with a temperature 40° is heated in the left part 3' of the heat recovery system by heat exchange with the hot blow down water supplied for example with temperature of 230° C. so that the make up water is heated for example to 60°. When thereafter the, make up water flows in the right part 3" of the heat recovery system and a heat transfer is performed with the condensing flush stream, for example with temperature of 230°, the make up water is heated further.

Figure 2:
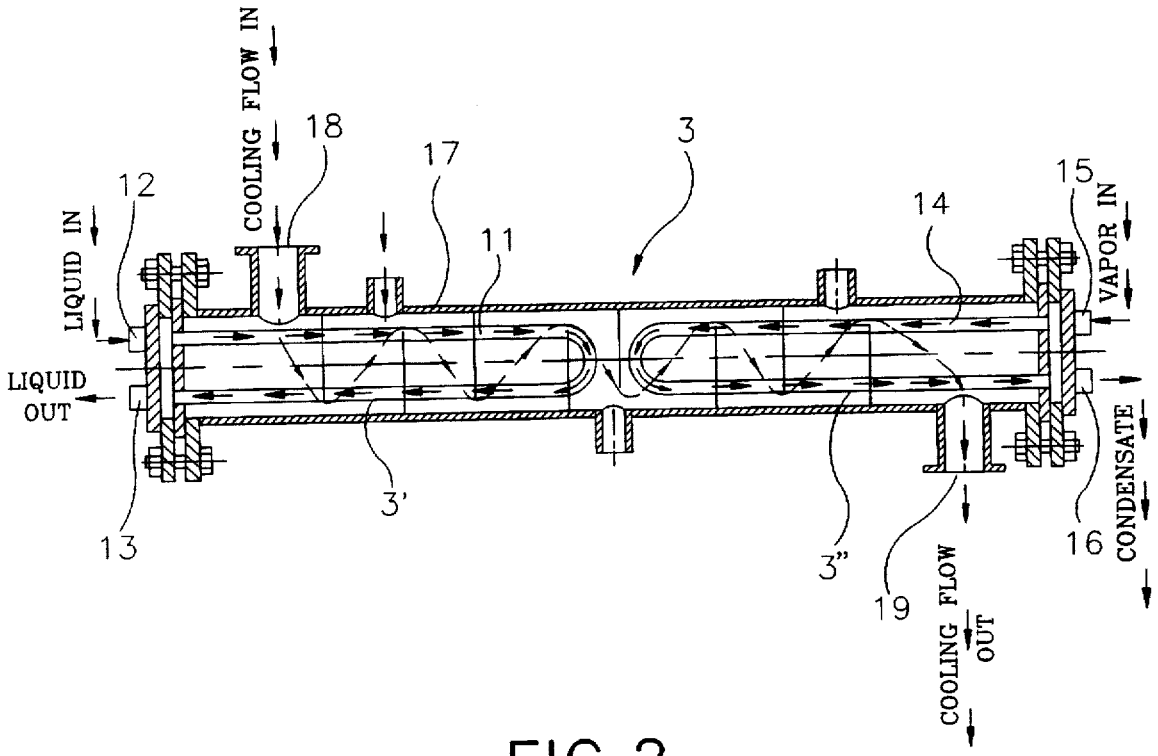
FIG. 2 is a view showing an inventive heat exchanger of the inventive system.

FIG. 2 shows details of the heat exchanger of the heat recovery system in accordance with the present invention. Here, the left tube bundle is identified as a whole with reference numeral 11 and has a fluid inlet 12 and a fluid outlet 13, the right tube bundle is identified with reference numeral 14 and has a fluid inlet 15 and a fluid outlet 16, and a shell is identified with reference numeral 17 and has a fluid inlet 18 and a fluid outlet 19.

It should be mentioned that the fluid which changes its phase state can be utilized further. In particular, the condensate produced from the vapor in the right tube bundle can be not only discharged, but also can be supplied back to a line leading to the source 1 of the two-phase flow or to another line in the inventive heat recovery system in which the liquid which does not change its state of aggregation flows.

It should also be mentioned that the heat exchanger can be formed as shown in FIG. 2, or alternatingly composed of two heat exchanging sections each including one of the tube bundles, and connected with one another in the middle as shown in broken lines in FIG. 1.

Figure 3:
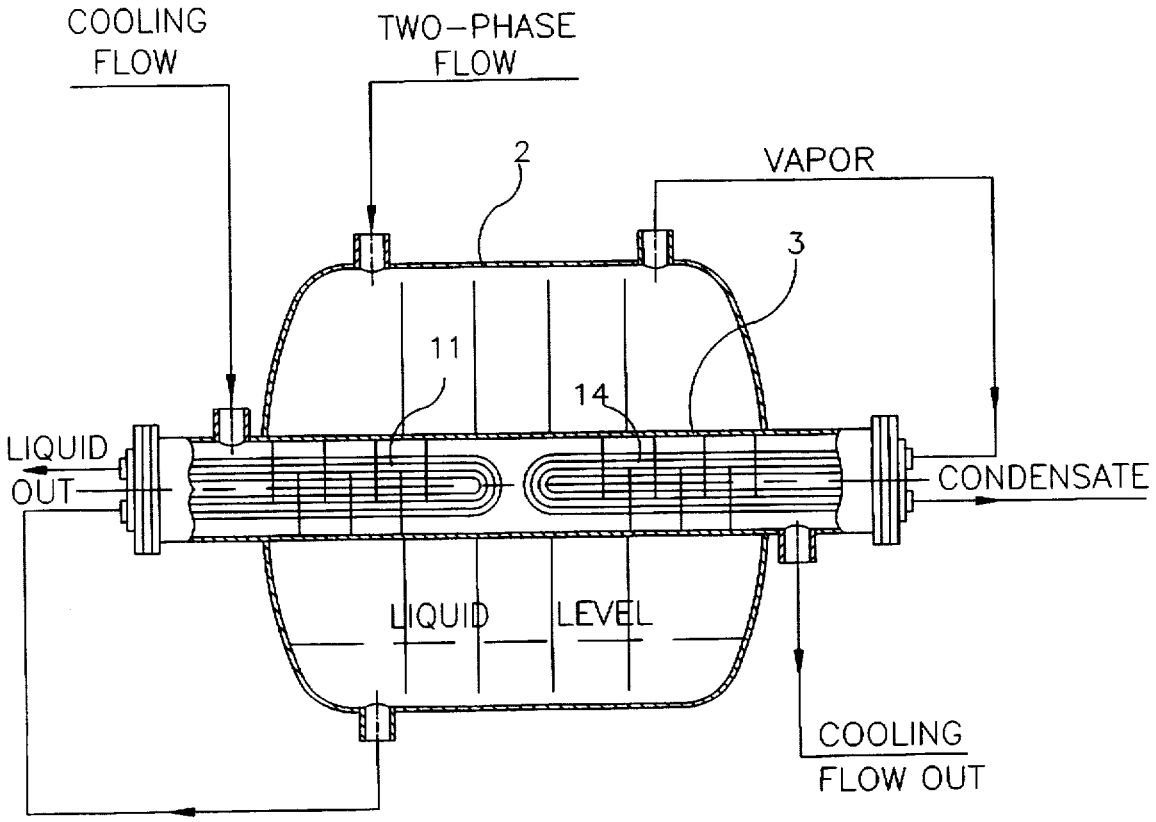
FIG. 3 is a view showing a further modification of the heat recovery system in accordance with the present invention.

The heat recovery system shown in FIG. 3 also includes the heat exchanger 3 formed in accordance with the present invention. In this embodiment, however, the heat exchanger is arranged directly in the tank separator 2. This simplifies the overall construction of the heat recovery system of the present invention.

Figure 4:
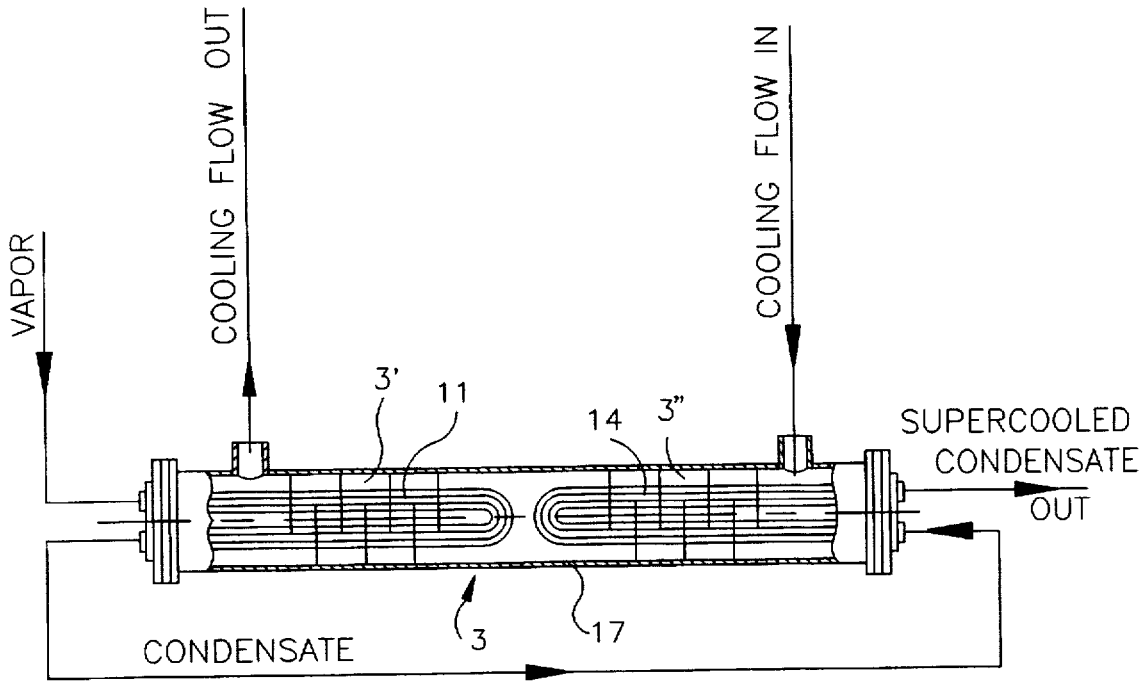
FIGS. 4–6 are views showing further modifications of the heat recovery system in accordance with the present invention.

While in the embodiment of FIG. 1 the fluid which passes through the left part 3' of the heat exchanger and does not change its phase state (liquid) and the fluid which passes through the right part 3" of the heat exchanger and changes its phase state (vapor ) are produced from the same source, in particular from the two-phase flow. FIG. 4 shows the heat recovery system in accordance with another embodiment. In the heat recovery system shown in this Figure, vapor which is a fluid which changes its phase state, is supplied into the tube bundle 11 arranged in the left part 3' of the heat recovery system. The vapor is condensed in the tube bundle 11 and then as a liquid which does not change its phase state, is supplied into the tube bundle 14 located in the right part 3" of the heat recovery system and is cooled in the tube bundle 14. In all above described embodiments, the third fluid is a cold fluid to be heated by heat recovered from two other fluids. In the embodiment of FIG. 4, similarly to the previous embodiments, the third, cool fluid is circulated inside the shell 17 so that again it is first brought in a heat transfer with the fluid which does not change its phase state (the condensate), and thereafter is brought into heat exchange with the fluid which changes its phase state (vapor).

Figure 5:
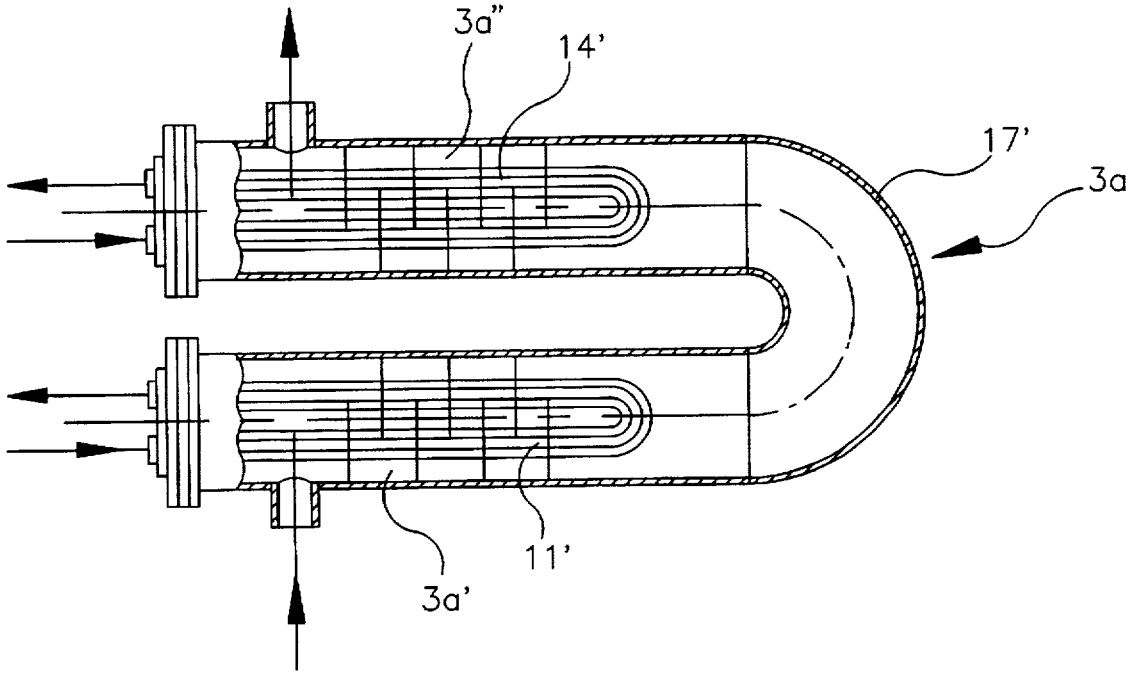

The heat recovery system shown in FIG. 5 has a first tube bundle 11" and a second tube bundle 14" which are arranged one after the other or in other words in series with one another in the parts 3a' and 3a" of the heat exchanger 3a. The third fluid is circulated through the interior of the shell 17". Here, however, the heat exchanger 3a is U-shaped. More particularly, its shell 17' is bent in a U-shaped manner, and the tube bundles 11' and 14' are located in the corresponding legs of the U-shape. In this construction the fluid inlets and outlets of the tube bundles and the shell are located at one side of the heat exchanger, and therefore servicing of the heat recovery system as well as its repair and maintenance are facilitated.

Figure 6:
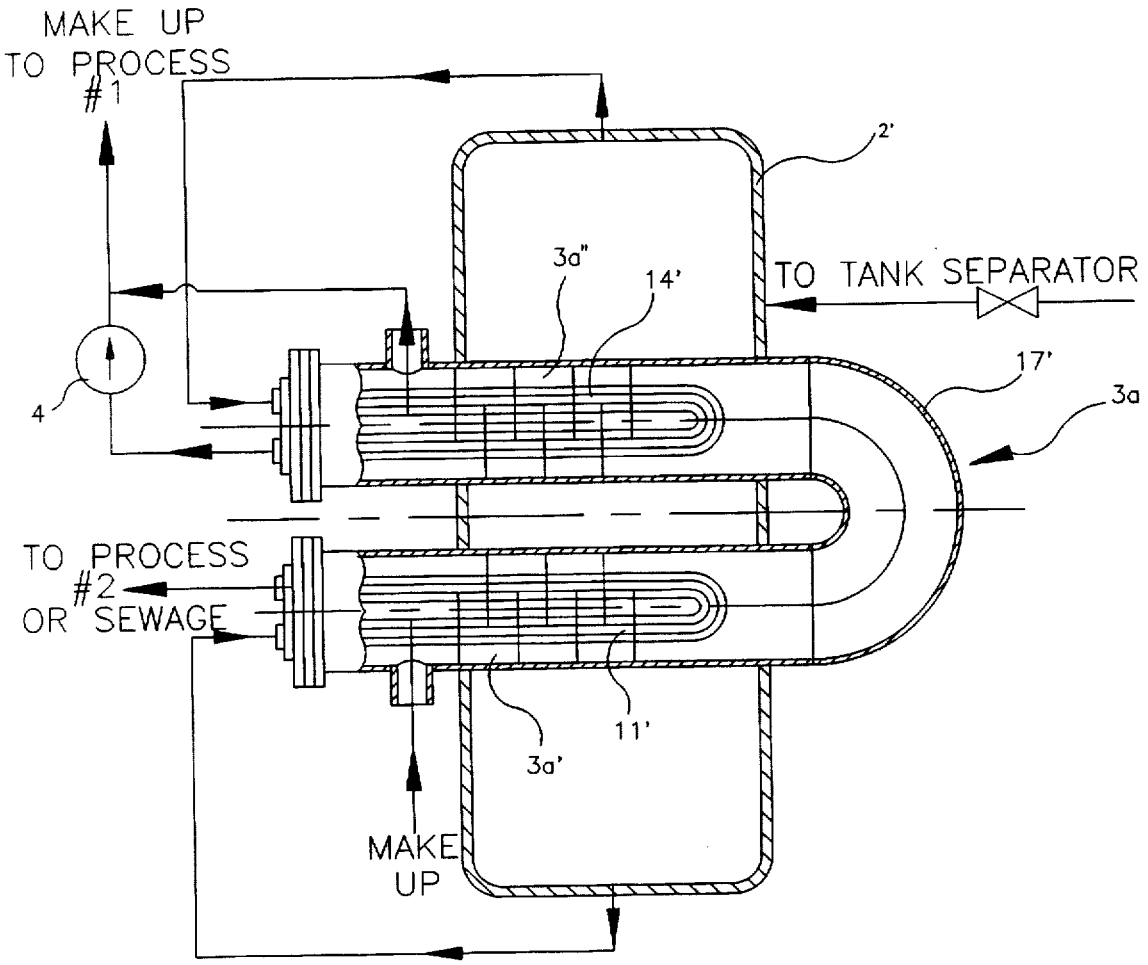

Finally, the embodiment of FIG. 6 shows a heat recovery system which substantially corresponds to the heat recovery system shown in FIG. 3, but is provided with a heat exchanger of FIG. 5. In particular, the heat exchanger 3a here is U-shaped and arranged in the tank separator 2'. Also, here a pump 4 is provided for recirculating of the condensed vapor back into a liquid line of this system.

It should be mentioned that the two fluids which are circulated in the two bundles can be fluids of the same chemical substance, for example a water flow and a steam flow. On the other hand, these two fluids can be formed by flows of different chemical substances, for example an ammonia vapor flow and a water flow, etc.

It will be understood that each of the elements described above, or two or more together, may also find a useful application in other types of constructions differing from the types described above.

While the invention has been illustrated and described as embodied in heat recovery system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of heat recovery, comprising the steps of providing a heat exchanger with a first tube bundle and a second tube bundle as well as a shell which accommodates the tube bundles arranged in series in the shell; circulating a first fluid which does not change its phase state through the first tube bundle, circulating a second fluid which changes its phase state through the second tube bundle; and circulating a third fluid through the shell so that the third fluid successively contacts the tube bundles for a successive heat transfer between the third fluid and a respective one of the two first-mentioned fluids, the third fluid being a cold fluid to be heated by heat transfer with the first and second fluids; and supplying the third fluid so that it first contacts the first tube bundle and is brought in a heat transfer first with the first fluid which does not change its phase state, and thereafter contacts the second tube bundle and is brought in heat transfer with the second fluid which changes its phase state.

2. A method as defined in claim 1; and further comprising the step of supplying the first fluid into the first tube bundle and supplying the second fluid into the second tube bundle independently from one another, so that the first fluid and the second fluid are separate fluids from separate sources.

3. A method as defined in claim 1; and further comprising the step of connecting tube side of the first tube bundle with tube side of the second tube bundle; and supplying at least one of the two first-mentioned fluids in at least one of the first and second tube bundles initially, so that in the at least one tube bundle the at least one of the first and second fluids changes its phase state and thereafter is supplied into the other of the first and second tube bundles as the other of the first and second fluids.

4. A method as defined in claim 1; and further comprising the step of arranging the shell so that it has an axis and extends substantially in an axial direction to have two axial ends; and arranging the tube bundles in the axial ends of the shell so that the tube bundles are spaced from one another in the axial direction.

5. A method as defined in claim 1; and further comprising the step of forming the shell substantially U-shaped with two leg portions connected with one another; and arranging the tube bundles in the leg portions so that each of the tube bundles is provided with a fluid inlet and a fluid outlet located at one side of the heat exchanger.

6. A method of heat recovery, comprising the steps of providing a heat exchanger with a first tube bundle and a second tube bundle as well as a shell which accommodates the tube bundles arranged in series in the shell; circulating a first fluid which does not change its phase state through the first tube bundle, circulating a second fluid which changes its phase state through the second tube bundle; circulating a third fluid through the shell so that the third fluid successively contacts the tube bundles for a successive heat transfer between the third fluid and a respective one of the two first-mentioned fluids; and separating an initial two-phase flow into the first fluid and the second fluid so as to supply the separated first fluid and the second fluid into the first tube bundle and the second tube bundle correspondingly.

* * * * *